US007897126B2

(12) United States Patent
Rappas et al.

(10) Patent No.: US 7,897,126 B2
(45) **Date of Patent: *Mar. 1, 2011**

(54) CATALYTIC GASIFICATION PROCESS WITH RECOVERY OF ALKALI METAL FROM CHAR

(75) Inventors: Alkis S. Rappas, Kingwood, TX (US); Robert A. Spitz, Abington, MA (US)

(73) Assignee: Greatpoint Energy, Inc., Cambridge, MA (US)

( * ) Notice: Subject to any disclaimer, the term of this patent is extended or adjusted under 35 U.S.C. 154(b) by 134 days.

This patent is subject to a terminal disclaimer.

(21) Appl. No.: 12/343,143

(22) Filed: Dec. 23, 2008

(65) Prior Publication Data

US 2009/0169448 A1 Jul. 2, 2009

Related U.S. Application Data

(60) Provisional application No. 61/017,314, filed on Dec. 28, 2007.

(51) Int. Cl.
*C01D 1/32* (2006.01)

(52) U.S. Cl. ..... 423/195; 423/335; 423/207; 423/179; 423/184; 48/197 FM; 48/127.7; 48/120; 502/20; 502/21; 502/22; 502/24; 502/25

(58) Field of Classification Search ..... 423/195, 423/207, 179, 184; 48/197 FM, 127.7, 120, 48/197; 502/20, 21, 22, 24, 25, 27
See application file for complete search history.

(56) References Cited

U.S. PATENT DOCUMENTS 2,813,126 A 11/1957 Tierney
2,886,405 A 5/1959 Benson et al.
3,114,930 A 12/1963 Oldham et al.
3,435,590 A 4/1969 Smith
3,531,917 A 10/1970 Grunewald et al.
3,594,985 A 7/1971 Ameen et al.
3,615,300 A 10/1971 Holm et al.
3,689,240 A 9/1972 Aldridge et al.

(Continued)

FOREIGN PATENT DOCUMENTS

CA 966660 4/1975

(Continued)

OTHER PUBLICATIONS

Asami, K., et al., "Highly Active Iron Catalysts from Ferric Chloride or the Steam Gasification of Brown Coal," ind. Eng. Chem. Res., vol. 32, No. 8, 1993, pp. 1631-1636.

(Continued)

*Primary Examiner* — Melvin C Mayes
*Assistant Examiner* — Melissa Stalder
(74) *Attorney, Agent, or Firm* — McDonnell Boehnen Hulbert & Berghoff LLP

(57) ABSTRACT

Processes are described for the extraction and recovery of alkali metal from the char that results from catalytic gasification of a carbonaceous material. Among other steps, the processes of the invention include a hydrothermal leaching step in which a slurry of insoluble particulate comprising insoluble alkali metal compounds is treated with carbon dioxide and steam at elevated temperatures and pressures to effect the conversion of insoluble alkali metal compounds to soluble alkali metal compounds. Further, processes are described for the catalytic gasification of a carbonaceous material where a substantial portion of alkali metal is extracted and recovered from the char that results from the catalytic gasification process.

21 Claims, 1 Drawing Sheet

U.S. PATENT DOCUMENTS 3,740,193 A 6/1973 Aldridge et al.
3,759,036 A 9/1973 White
3,779,725 A 12/1973 Hegarty et al.
3,828,474 A 8/1974 Quartulli
3,847,567 A 11/1974 Kalina et al.
3,904,386 A 9/1975 Graboski et al.
3,915,670 A 10/1975 Lacey et al.
3,920,229 A 11/1975 Piggott
3,929,431 A 12/1975 Koh et al.
3,958,957 A 5/1976 Koh et al.
3,969,089 A 7/1976 Moss et al.
3,975,168 A 8/1976 Gorbaty
3,985,519 A 10/1976 Kalina et al.
3,998,607 A 12/1976 Wesselhoft et al.
3,999,607 A 12/1976 Pennington et al.
4,005,996 A 2/1977 Hausberger et al.
4,021,370 A 5/1977 Harris et al.
4,046,523 A 9/1977 Kalina et al.
4,053,554 A 10/1977 Reed et al.
4,057,512 A 11/1977 Vadovic et al.
4,069,304 A 1/1978 Starkovich et al.
4,077,778 A 3/1978 Nahas et al.
4,091,073 A 5/1978 Winkler
4,092,125 A 5/1978 Stambaugh et al.
4,094,650 A 6/1978 Koh et al.
4,100,256 A 7/1978 Bozzelli et al.
4,101,449 A 7/1978 Noda et al.
4,104,201 A 8/1978 Banks et al.
4,118,204 A 10/1978 Eakman et al.
4,152,119 A 5/1979 Schulz
4,157,246 A 6/1979 Eakman et al.
4,159,195 A 6/1979 Clavenna
4,193,771 A 3/1980 Sharp et al.
4,193,772 A 3/1980 Sharp
4,200,439 A 4/1980 Lang
4,204,843 A 5/1980 Neavel
4,211,538 A 7/1980 Eakman et al.
4,211,669 A 7/1980 Eakman et al.
4,219,338 A * 8/1980 Wolfs et al. ..... 48/197 R
4,235,044 A 11/1980 Cheung
4,243,639 A 1/1981 Haas et al.
4,260,421 A 4/1981 Brown et al.
4,265,868 A 5/1981 Kamody
4,284,416 A 8/1981 Nahas
4,292,048 A 9/1981 Wesselhoft et al.
4,315,758 A 2/1982 Patel et al.
4,318,712 A 3/1982 Lang et al.
4,330,305 A 5/1982 Kuessner et al.
4,331,451 A 5/1982 Isogaya et al.
4,334,893 A 6/1982 Lang
4,336,034 A 6/1982 Lang et al.
4,336,233 A 6/1982 Appl et al.
4,347,063 A 8/1982 Sherwood et al.
4,348,486 A 9/1982 Calvin et al.
4,348,487 A 9/1982 Goldstein et al.
4,353,713 A 10/1982 Cheng
4,365,975 A 12/1982 Williams et al.
4,375,362 A 3/1983 Moss
4,397,656 A 8/1983 Ketkar
4,400,182 A 8/1983 Davies et al.
4,407,206 A 10/1983 Bartok et al.
4,432,773 A 2/1984 Euker, Jr. et al.
4,433,065 A 2/1984 Van Der Burgt et al.
4,436,531 A 3/1984 Estabrook et al.
4,439,210 A 3/1984 Lancet
4,444,568 A 4/1984 Beisswenger et al.
4,459,138 A * 7/1984 Soung ..... 48/197 R
4,462,814 A 7/1984 Holmes et al.
4,466,828 A 8/1984 Tamai et al.
4,468,231 A 8/1984 Bartok et al.
4,500,323 A 2/1985 Siegfried et al.
4,508,544 A 4/1985 Moss
4,515,604 A 5/1985 Eisenlohr et al.
4,515,764 A 5/1985 Diaz
4,540,681 A 9/1985 Kustes et al.
4,541,841 A 9/1985 Reinhardt
4,551,155 A 11/1985 Wood et al.
4,558,027 A 12/1985 McKee et al.
4,597,775 A 7/1986 Billimoria et al.
4,597,776 A 7/1986 Ullman et al.
4,604,105 A 8/1986 Aquino et al.
4,609,456 A 9/1986 Deschamps et al.
4,617,027 A 10/1986 Lang
4,619,864 A 10/1986 Hendrix et al.
4,661,237 A 4/1987 Kimura et al.
4,668,428 A 5/1987 Najjar
4,668,429 A 5/1987 Najjar
4,675,035 A 6/1987 Apffel
4,678,480 A 7/1987 Heinrich et al.
4,682,986 A 7/1987 Lee et al.
4,690,814 A 9/1987 Velenyi et al.
4,704,136 A 11/1987 Weston et al.
4,720,289 A 1/1988 Vaugh et al.
4,747,938 A 5/1988 Khan
4,781,731 A 11/1988 Schlinger
4,803,061 A 2/1989 Najjar et al.
4,822,935 A 4/1989 Scott
4,848,983 A 7/1989 Tomita et al.
4,854,944 A 8/1989 Strong
4,861,360 A 8/1989 Apffel
4,876,080 A 10/1989 Paulson
4,960,450 A 10/1990 Schwarz et al.
4,995,193 A 2/1991 Soga et al.
5,017,282 A 5/1991 Delbianco et al.
5,055,181 A 10/1991 Maa et al.
5,057,294 A 10/1991 Sheth et al.
5,059,406 A 10/1991 Sheth et al.
5,093,094 A 3/1992 Van Kleeck et al.
5,094,737 A 3/1992 Bearden, Jr. et al.
5,132,007 A 7/1992 Meyer et al.
5,223,173 A 6/1993 Jeffrey
5,250,083 A 10/1993 Wolfenbarger et al.
5,277,884 A 1/1994 Shinnar et al.
5,435,940 A 7/1995 Doering et al.
5,536,893 A 7/1996 Gudmundsson
5,616,154 A 4/1997 Elliott et al.
5,630,854 A 5/1997 Sealock, Jr. et al.
5,641,327 A 6/1997 Leas
5,720,785 A 2/1998 Baker
5,733,515 A 3/1998 Doughty et al.
5,776,212 A 7/1998 Leas
5,855,631 A 1/1999 Leas
5,865,898 A 2/1999 Holtzapple et al.
6,013,158 A 1/2000 Wootten
6,015,104 A 1/2000 Rich, Jr.
6,028,234 A 2/2000 Heinemann et al.
6,090,356 A 7/2000 Jahnke et al.
6,180,843 B1 1/2001 Heinemann et al.
6,187,465 B1 2/2001 Galloway
6,389,820 B1 5/2002 Rogers et al.
6,506,349 B1 1/2003 Khanmamedov
6,506,361 B1 1/2003 Machado et al.
6,602,326 B2 8/2003 Lee et al.
6,641,625 B1 11/2003 Clawson et al.
6,653,516 B1 11/2003 Yoshikawa et al.
6,692,711 B1 2/2004 Alexion et al.
6,790,430 B1 9/2004 Lackner et al.
6,797,253 B2 9/2004 Lyon
6,808,543 B2 10/2004 Paisley
6,855,852 B1 2/2005 Jackson et al.
6,894,183 B2 5/2005 Choudhary et al.
6,955,695 B2 10/2005 Nahas
7,074,373 B1 7/2006 Warren et al.
7,132,183 B2 11/2006 Galloway
7,205,448 B2 4/2007 Gajda et al.
7,220,502 B2 5/2007 Galloway
7,309,383 B2 12/2007 Beech, Jr. et al.
2003/0167691 A1 9/2003 Nahas
2004/0020123 A1 2/2004 Kimura et al.
2004/0180971 A1 9/2004 Inoue et al.
2005/0107648 A1 5/2005 Kimura et al.
2005/0137442 A1 6/2005 Gajda et al.
2006/0265953 A1 11/2006 Hobbs
2007/0000177 A1 1/2007 Hippo et al.
2007/0051043 A1 3/2007 Schingnitz
2007/0083072 A1 4/2007 Nahas
2007/0180990 A1 8/2007 Downs et al.

| | | | |
|---|---|---|---|
| 2007/0186472 | A1 | 8/2007 | Rabovitser et al. |
| 2007/0277437 | A1 | 12/2007 | Sheth |
| 2009/0048476 | A1 | 2/2009 | Rappas et al. |
| 2009/0090055 | A1 | 4/2009 | Ohtsuka |
| 2009/0090056 | A1 | 4/2009 | Ohtsuka |
| 2009/0165361 | A1 | 7/2009 | Rappas et al. |
| 2009/0165376 | A1 | 7/2009 | Lau et al. |
| 2009/0165379 | A1 | 7/2009 | Rappas |
| 2009/0165380 | A1 | 7/2009 | Lau et al. |
| 2009/0165381 | A1 | 7/2009 | Robinson |
| 2009/0165382 | A1 | 7/2009 | Rappas et al. |
| 2009/0165383 | A1 | 7/2009 | Rappas et al. |
| 2009/0165384 | A1 | 7/2009 | Lau et al. |
| 2009/0166588 | A1 | 7/2009 | Spitz et al. |
| 2009/0169448 | A1 | 7/2009 | Rappas et al. |
| 2009/0169449 | A1 | 7/2009 | Rappas et al. |
| 2009/0170968 | A1 | 7/2009 | Nahas et al. |
| 2009/0217575 | A1 | 9/2009 | Raman et al. |
| 2009/0217582 | A1 | 9/2009 | May et al. |
| 2009/0217584 | A1 | 9/2009 | Raman et al. |
| 2009/0217585 | A1 | 9/2009 | Raman et al. |
| 2009/0217586 | A1 | 9/2009 | Rappas et al. |
| 2009/0217587 | A1 | 9/2009 | Raman et al. |
| 2009/0217588 | A1 | 9/2009 | Hippo et al. |
| 2009/0217589 | A1 | 9/2009 | Robinson |
| 2009/0217590 | A1 | 9/2009 | Rappas et al. |
| 2009/0218424 | A1 | 9/2009 | Hauserman |
| 2009/0220406 | A1 | 9/2009 | Rahman |
| 2009/0229182 | A1 | 9/2009 | Raman et al. |
| 2009/0246120 | A1 | 10/2009 | Raman et al. |
| 2009/0259080 | A1 | 10/2009 | Raman et al. |
| 2009/0260287 | A1 | 10/2009 | Lau |
| 2009/0324458 | A1 | 12/2009 | Robinson et al. |
| 2009/0324459 | A1 | 12/2009 | Robinson et al. |
| 2009/0324460 | A1 | 12/2009 | Robinson et al. |
| 2009/0324461 | A1 | 12/2009 | Robinson et al. |
| 2009/0324462 | A1 | 12/2009 | Robinson et al. |
| 2010/0071262 | A1 | 3/2010 | Robinson et al. |
| 2010/0076235 | A1 | 3/2010 | Reiling et al. |
| 2010/0120926 | A1 | 5/2010 | Robinson et al. |
| 2010/0121125 | A1 | 5/2010 | Hippo et al. |
| 2010/0168494 | A1 | 7/2010 | Rappas et al. |
| 2010/0168495 | A1 | 7/2010 | Rappas et al. |
| 2010/0179232 | A1 | 7/2010 | Robinson et al. |

FOREIGN PATENT DOCUMENTS

| | | |
|---|---|---|
| CA | 1003217 | 1/1977 |
| CA | 1106178 | 8/1981 |
| CA | 1187702 | 6/1985 |
| CN | 1477090 | 2/2004 |
| DE | 2210891 | 9/1972 |
| DE | 2852710 | 6/1980 |
| DE | 3422202 | 12/1985 |
| DE | 100610607 | 6/2002 |
| EA | 819 | 4/2000 |
| EP | 0 067 580 | 12/1982 |
| EP | 102828 | 3/1984 |
| EP | 0 138 463 | 4/1985 |
| EP | 0 225 146 | 6/1987 |
| EP | 0 259 927 | 3/1988 |
| EP | 0 723 930 | 7/1996 |
| EP | 1 001 002 | 5/2000 |
| EP | 1 741 673 | 6/2006 |
| FR | 797 089 | 4/1936 |
| GB | 593910 | 10/1947 |
| GB | 640907 | 8/1950 |
| GB | 676615 | 7/1952 |
| GB | 701 131 | 12/1953 |
| GB | 760627 | 11/1956 |
| GB | 798741 | 7/1958 |
| GB | 996327 | 6/1965 |
| GB | 1033764 | 6/1966 |
| GB | 1448562 | 9/1976 |
| GB | 1453081 | 10/1976 |
| GB | 1467219 | 3/1977 |
| GB | 1467995 | 3/1977 |
| GB | 1 599 932 | 7/1977 |
| GB | 2078251 | 1/1982 |
| GB | 2154600 | 9/1985 |
| JP | 54020003 | 2/1979 |
| JP | 56157493 | 12/1981 |
| JP | 62241991 | 10/1987 |
| JP | 62 257985 | 11/1987 |
| JP | 2000290659 | 10/2000 |
| JP | 2000290670 | 10/2000 |
| JP | 2002105467 | 4/2002 |
| JP | 2004292200 | 10/2004 |
| JP | 2004298818 | 10/2004 |
| WO | WO 00/43468 | 7/2000 |
| WO | WO 02/40768 | 5/2002 |
| WO | WO 02/079355 | 10/2002 |
| WO | WO 03/033624 | 4/2003 |
| WO | WO 2004/072210 | 8/2004 |
| WO | WO 2006/031011 | 3/2006 |
| WO | WO 2007/005284 | 1/2007 |
| WO | WO 2007/047210 | 4/2007 |
| WO | WO 2007/076363 | 7/2007 |
| WO | WO 2007/128370 | 11/2007 |
| WO | WO 2007/143376 | 12/2007 |
| WO | WO 2008/073889 | 6/2008 |
| WO | WO 2009/018053 | 2/2009 |
| WO | WO 2009/048723 | 4/2009 |
| WO | WO 2009/048724 | 4/2009 |
| WO | WO 2009/086361 | 7/2009 |
| WO | WO 2009/086362 | 7/2009 |
| WO | WO 2009/086363 | 7/2009 |
| WO | WO 2009/086366 | 7/2009 |
| WO | WO 2009/086367 | 7/2009 |
| WO | WO 2009/086370 | 7/2009 |
| WO | WO 2009/086372 | 7/2009 |
| WO | WO 2009/086374 | 7/2009 |
| WO | WO 2009/086377 | 7/2009 |
| WO | WO 2009/086383 | 7/2009 |
| WO | WO 2009/086407 | 7/2009 |
| WO | WO 2009/086408 | 7/2009 |
| WO | WO 2009/111330 | 9/2009 |
| WO | WO 2009/111331 | 9/2009 |
| WO | WO 2009/111332 | 9/2009 |
| WO | WO 2009/111335 | 9/2009 |
| WO | WO 2009/111342 | 9/2009 |
| WO | WO 2009/111345 | 9/2009 |
| WO | WO 2009/124017 | 10/2009 |
| WO | WO 2009/124019 | 10/2009 |
| WO | WO 2009/158576 | 12/2009 |
| WO | WO 2009/158579 | 12/2009 |
| WO | WO 2009/158580 | 12/2009 |
| WO | WO 2009/158582 | 12/2009 |
| WO | WO 2009/158583 | 12/2009 |
| WO | WO 2010/033846 | 3/2010 |
| WO | WO 2010/033848 | 3/2010 |
| WO | WO 2010/033850 | 3/2010 |
| WO | WO 2010/033852 | 3/2010 |
| WO | WO 2010/048493 | 4/2010 |
| WO | WO 2010/078297 | 7/2010 |
| WO | WO 2010/078298 | 7/2010 |

OTHER PUBLICATIONS

Berger, R., et al., "High Temperature $CO_2$-Absorption: A Process Offering New Prospects in Fuel Chemistry," The Fifth International Symposium on Coal Combustion, Nov. 2003, Nanjing, China, pp. 547-549.

Brown et al., "Biomass-Derived Hydrogen From a Thermally Ballasted Gasifier," Aug. 2005.

Brown et al., "Biomass-Derived Hydrogen From a Thermally Ballasted Gasifier," DOE Hydrogen Program Contractors' Review Metting, Center for Sustainable Environmental Technologies, Iowa State University, May 21, 2003.

Coal Conversion Processes (Gasification), Encyclopedia of Chemical Technology, 4$^{th}$ Edition, vol. 6, pp. 541-566, 1993.

Cohen, S.J., Project Manager, "Large Pilot Plant Alternatives for Scaleup of the Catalytic Coal Gasification Process," FE-2480-20, U.S. Dept. of Energy, Contract No. EX-76-C-01-2480, 1979.

Euker, Jr., C.A., Reitz, R.A., Program Managers, "Exxon Catalytic Coal-Gasification-Process Development Program," Exxon Research & Engineering Company, FE-2777-31, U.S. Dept. of Energy, Contract No. ET-78-C-01-2777, 1981.

Kalina, T., Nahas, N.C., Project Managers, "Exxon Catalaytic Coal Gasification Process Predevelopment Program," Exxon Research & Engineering Company, FE-2369-24, U.S. Dept. of Energy, Contract No. E(49-18)-2369, 1978.
Nahas, N.C., "Exxon Catalytic Coal Gasification Process—Fundamentals to Flowsheets," Fuel, vol. 62, No. 2, 1983, pp. 239-241.
Ohtsuka, Y. et al., "Highly Active Catalysts from Inexpensive Raw Materials for Coal Gasification," Catalysis Today, vol. 39, 1997, pp. 111-125.
Ohtsuka, Yasuo et al, "Steam Gasification of Low-Rank Coals with a Chlorine-Free Iron Catalyst from Ferric Chloride," Ind. Eng. Chem. Res., vol. 30, No. 8, 1991, pp. 1921-1926.
Ohtsuka, Yasuo et al., "Calcium Catalysed Steam Gasification of Yalourn Brown Coal," Fuel, vol. 65, 1986, pp. 1653-1657.
Ohtsuka, Yasuo, et al, "Iron-Catalyzed Gasification of Brown Coal at Low Temperatures," Energy & Fuels, vol. 1, No. 1, 1987, pp. 32-36.
Ohtsuka, Yasuo, et al., "Ion-Exchanged Calcium From Calcium Carbonate and Low-Rank Coals: High Catalytic Activity in Steam Gasification," Energy & Fuels 1996, 10, pp. 431-435.
Ohtsuka, Yasuo et al., "Steam Gasification of Coals with Calcium Hydroxide," Energy & Fuels, vol. 9, No. 6, 1995, pp. 1038-1042.
Pereira, P., et al., "Catalytic Steam Gasification of Coals," Energy & Fuels, vol. 6, No. 4, 1992, pp. 407-410.
Ruan Xiang-Quan, et al., "Effects of Catalysis on Gasification of Tatong Coal Char," Fuel, vol. 66, Apr. 1987, pp. 568-571.
Tandon, D., "Low Temperature and Elevated Pressure Steam Gasification of Illinois Coal," College of Engineering in the Graduate School, Southern Illinois university at Carbondale, Jun. 1996.
"Integrate Gasification Combined Cycle (IGCC)," WorleyParsons Resources & Energy, http://www.worleyparsons.com/v5/page.aspx?id=164, 2001.
U.S. Appl. No. 12/778,538, filed May 12, 2010, Robinson, et al.
U.S. Appl. No. 12/778,548, filed May 12, 2010, Robinson, et al.
U.S. Appl. No. 12/778,552, filed May 12, 2010, Robinson, et al.
Adsorption, http://en.wikipedia.org/wiki/Adsorption, pp. 1-8, 2010.
Amine gas treating, http://en.wikipedia.org/wiki/Acid_gas_removal, pp. 1-4, Nov. 2007.
Coal, http://en.wikipedia.org/wiki/Coal_gasification, pp. 1-8, 2010.
Coal Data: A Reference, Energy Information Administration, Office of Coal, Nuclear, Electric, and Alternate Fuels U.S. Department of Energy, DOE/EIA-0064(93), Feb. 1995.
Deepak Tandon, Dissertation Approval, "Low Temperature and Elevated Pressure Steam Gasification of Illinois Coal", Jun. 13, 1996.
Demibras, "Demineralization of Agricultural Residues by Water Leaching", *Energy Sources*, vol. 25, pp. 679-687, (2003).
Fluidized Bed Gasifiers, http://www.energyproducts.com/fluidized_bed_gasifiers.htm, pp. 1-5, Nov. 2007.
Gas separation, http://en.wikipedia.org/wiki/Gas_separation, pp. 1-2, 2010.
Gasification, http://en.wikipedia.org/wiki/Gasification, pp. 1-6, Nov. 2007.
Gallagher Jr., et al., "Catalytic Coal Gasification for SNG Manufacture", *Energy Research*, vol. 4, pp. 137-147, (1980).
Heinemann, et al., "Fundamental and Exploratory Studies of Catalytic Steam Gasification of Carbonaceous Materials", Final Report Fiscal Years 1985-1994.
Jensen, et al. Removal of K and C1 by leaching of straw char, *Biomass and Bioenergy*, vol. 20, pp. 447-457, (2001).
Mengjie, et al., "A potential renewable energy resource development and utilization of biomass energy", http://www.fao.org.docrep/T4470E/t4470e0n.htm, pp. 1-8, Jan. 2008.
Meyers, et al. Fly Ash as A Construction Material for Highways, A Manual. Federal Highway Administration, Report No. FHWA-IP-76-16, Washington, DC, 1976.
Moulton, Lyle K. "Bottom Ash and Boiler Slag", *Proceedings of the Third International Ash Utilization Symposium*, U.S. Bureau of Mines, Information Circular No. 8640, Washington, DC, 1973.
Natural gas processing, http://en.wikipedia.org/wiki/Natural_gas_processing, pp. 1-4, 2007.
Natural Gas Processing: The Crucial Link Between Natural Gas Production and Its Transportation to Market. Energy Information Administration, Office of Oil and Gas; pp. 1-11, (2006).
Prins, et al., "Exergetic optimisation of a production process of Fischer-Tropsch fuels from biomass", *Fuel Processing Technology*, vol. 86, pp. 375-389, (2004).
Reboiler, http://en.wikipedia.org/wiki/Reboiler, pp. 1-4, 2008.
What is XPS?, http://www.nuance.northwestern.edu/Keckll/xps1.asp, pp. 1-2, 2008.
2.3 Types of gasifiers, http://www.fao.org/docrep/t0512e/T0512e0a.htm, pp. 1-6, 2007.
2.4 Gasification fuels, http://www.fao.org/docrep/t0512e/T0512e0b.htm#TopofPage, pp. 1-8, 2007.
2.5 Design of downdraught gasifiers, http://www.fao.org/docrep/t0512e/T0512e0c.htm#TopOfPage, pp. 1-8, 2007.
2.6 Gas cleaning and cooling, http://www.fao.org/docrep/t0512e0d.htm#TopOFPage, pp. 1-3, 2007.

* cited by examiner

CATALYTIC GASIFICATION PROCESS WITH RECOVERY OF ALKALI METAL FROM CHAR

CROSS-REFERENCE TO RELATED APPLICATIONS

This application claims priority under 35 U.S.C. §119 from U.S. Provisional Application Ser. No. 61/017,314 (filed Dec. 28, 2007), the disclosure of which is incorporated by reference herein for all purposes as if fully set forth.

This application is related to commonly owned U.S. application Ser. No. 11/421,511, filed Jun. 1, 2006, entitled "CATALYTIC STEAM GASIFICATION PROCESS WITH RECOVERY AND RECYCLE OF ALKALI METAL COMPOUNDS"; U.S. application Ser. No. 12/342,554 (filed concurrently herewith), entitled "CATALYTIC GASIFICATION PROCESS WITH RECOVERY OF ALKALI METAL FROM CHAR" U.S. application Ser. No. 12/342,715 (filed concurrently herewith), entitled "CATALYTIC GASIFICATION PROCESS WITH RECOVERY OF ALKALI METAL FROM CHAR"; and U.S. application Ser. No. 12/342,736 (filed concurrently herewith), entitled "CATALYTIC GASIFICATION PROCESS WITH RECOVERY OF ALKALI METAL FROM CHAR".

FIELD OF THE INVENTION

The present invention relates to a catalytic gasification process that involves the extraction and recovery of alkali metal from char that remains following catalytic gasification of a carbonaceous composition. Further, the invention relates to processes for extracting and recovering alkali metal from char by reacting a slurry of char particulate with carbon dioxide under suitable temperature and pressure so as to convert insoluble alkali metal compounds contained in the insoluble char particulate to soluble alkali metal compounds.

BACKGROUND OF THE INVENTION

In view of numerous factors such as higher energy prices and environmental concerns, the production of value-added gaseous products from lower-fuel-value carbonaceous feedstocks, such as petroleum coke and coal, is receiving renewed attention. The catalytic gasification of such materials to produce methane and other value-added gases is disclosed, for example, in U.S. Pat. Nos. 3,828,474, 3,998,607, 4,057,512, 4,092,125, 4,094,650, 4,204,843, 4,468,231, 4,500,323, 4,541,841, 4,551,155, 4,558,027, 4,606,105, 4,617,027, 4,609,456, 5,017,282, 5,055,181, 6,187,465, 6,790,430, 6,894,183, 6,955,695, US2003/0167961A1, US2006/0265953A1, US2007/000177A1, US2007/083072A1, US2007/0277437A1 and GB 1599932.

Gasification of a carbonaceous material, such as coal or petroleum coke, can be catalyzed by loading the carbonaceous material with a catalyst comprising an alkali metal source. US2007/0000177A1 and US2007/0083072A1, both incorporated herein by reference, disclose the alkali-metal-catalyzed gasification of carbonaceous materials. Lower-fuel-value carbon sources, such as coal, typically contain quantities of inorganic matter, including compounds of silicon, aluminum, calcium, iron, vanadium, sulfur, and the like. This inorganic content is referred to as ash. Silica and alumina are especially common ash components. At temperatures above 500-600° C., alkali metal compounds can react with the alumina and silica to form alkali metal aluminosilicates. As an aluminosilicate, the alkali metal compound is substantially insoluble in water and has little effectiveness as a gasification catalyst.

At typical catalytic gasification temperatures, most components of ash are not gasified, and thus build up with other compounds in the gasification reactor as a solid residue referred to as char. For catalytic gasification, char generally includes ash, unconverted carbonaceous material, and alkali metal compounds (from the catalyst). The char must be periodically withdrawn from the reactor through a solid purge. The char may contain substantial quantities of alkali metal compounds. The alkali metal compounds may exist in the char as soluble species, such as potassium carbonate, but may also exist as insoluble species, such as potassium aluminosilicate (e.g., kaliophilite). It is desirable to recover the soluble and the insoluble alkali metal compounds from the solid purge for subsequent reuse as a gasification catalyst. A need remains for efficient processes for recovering soluble and insoluble alkali metal compounds from char. Such processes should effect substantial recovery of alkali metal compounds from the char, minimize the complexity of the processing steps, reduce the use of consumable raw materials, and generate few waste products that require disposal.

SUMMARY OF THE INVENTION

The present invention provides processes for converting a carbonaceous composition into a plurality of gaseous products with recovery of an alkali metal compounds that can be reused as a gasification catalyst. The invention further provides processes for extracting and recovering catalytically useful alkali metal compounds from soluble and insoluble alkali metal compounds contained in char, where the processes involve thermal quenching of the char in an aqueous medium followed by treatment of the char particulate with carbon dioxide gas under hydrothermal conditions.

In a first aspect, the invention provides a process for extracting and recovering alkali metal from a char, the char comprising (i) one or more soluble alkali metal compounds and (ii) insoluble matter comprising one or more insoluble alkali metal compounds, the process comprising the steps of: (a) providing char at an elevated temperature ranging from 50° C. to about 600° C.; (b) quenching the char in an aqueous medium to fracture the char and form a quenched char slurry; (c) contacting the quenched char slurry with carbon dioxide under suitable pressure and temperature so as to convert at least a portion of the insoluble alkali metal compounds to one or more soluble alkali metal compounds, and produce a leached slurry comprising the soluble alkali metal compounds and residual insoluble matter; (d) degassing the leached slurry under suitable pressure and temperature so as to remove a substantial portion of the excess carbon dioxide and hydrogen sulfide, if present, and produce a degassed leached slurry; (e) separating the degassed leached slurry into a liquid stream and a residual insoluble matter stream, the liquid stream comprising a predominant portion of the soluble alkali metal compounds from the degassed leached slurry, and the residual insoluble matter stream comprising residual soluble alkali metal compounds and residual insoluble alkali metal compounds; (f) recovering the liquid stream; and (g) washing the extracted insoluble matter stream with an aqueous medium to produce a wash stream comprising substantially all of the residual soluble alkali metal compounds from the residual insoluble matter stream, wherein the quenching and contacting is performed in the substantial absence of gaseous oxygen.

In a second aspect, the invention provides a process for catalytically converting a carbonaceous composition, in the presence of an alkali metal gasification catalyst, into a plurality of gaseous products, the process comprising the steps of: (a) supplying a carbonaceous composition to a gasification reactor, the carbonaceous composition comprising an ash; (b) reacting the carbonaceous composition in the gasification reactor in the presence of steam and an alkali metal gasification catalyst under suitable temperature and pressure to form (i) a char comprising alkali metal from the alkali metal gasification catalyst in the form of one or more soluble alkali metal compounds and one or more insoluble alkali metal compounds, and (ii) a plurality of gaseous products comprising methane and one or more of hydrogen, carbon monoxide, carbon dioxide, hydrogen sulfide, ammonia, and other higher hydrocarbons; (c) removing a portion of the char from the gasification reactor; (d) extracting and recovering a substantial portion of the alkali metal from the char according to the first aspect of the invention; and (e) at least partially separating the plurality of gaseous products to produce a stream comprising a predominant amount of one of the gaseous products.

The process can be run continuously, and the recovered alkali metal can be recycled back into the process to minimize the amount of makeup catalyst required.

DETAILED DESCRIPTION

Figure 1:
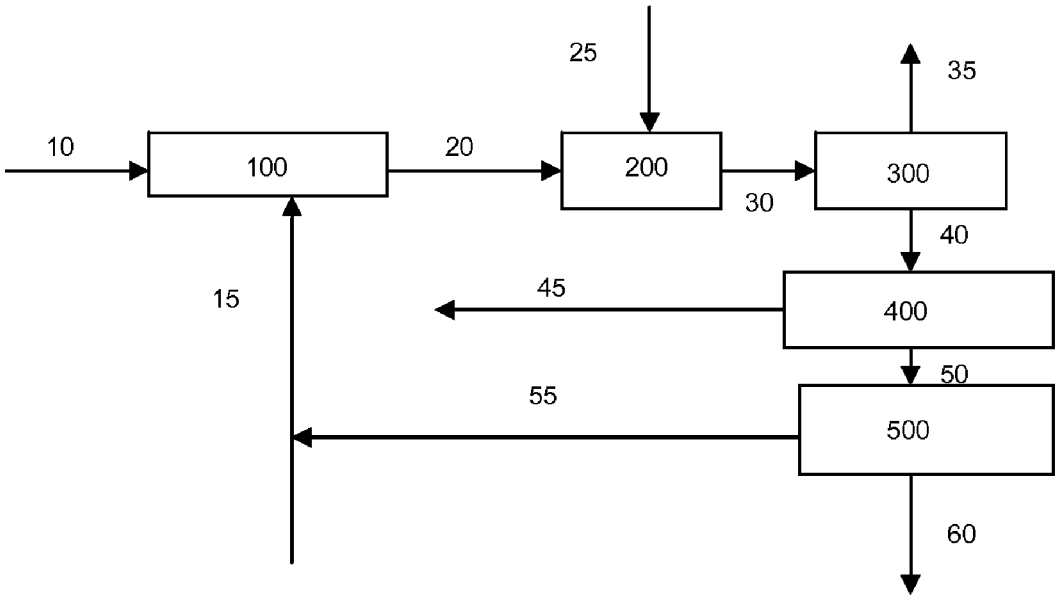
FIG. 1 provides a schematic diagram for one example of a process for recovering alkali metal from char for reuse as a catalyst in a catalytic gasification process.

The present invention relates to processes for the catalytic conversion of a carbonaceous composition into a plurality of gaseous products with substantial recovery of alkali metal used in the gasification catalyst. The alkali metal is recovered from char that develops as a result of the catalyzed gasification of a carbonaceous material in a gasification reactor. The alkali metal may exist in the char in either water-soluble or water-insoluble forms. The present invention provides efficient processes for extracting and recovering substantially all of the soluble and insoluble alkali metal from char. Among other steps, these processes include the quenching of the char in an aqueous solution to fracture the char, dissolving substantially all of the water-soluble alkali metal compounds, and forming a slurry of the quenched char, and the reacting of a char slurry with carbon dioxide at suitable pressures and temperatures to solubilize and extract insoluble alkali metal compounds. In this manner, soluble and insoluble alkali metal compounds are substantially removed from char using simplified processes that require few consumable raw materials.

The present invention can be practiced, for example, using any of the developments to catalytic gasification technology disclosed in commonly owned US2007/0000177A1, US2007/0083072A1 and US2007/0277437A1; and U.S. patent application Ser. No. 12/178,380 (filed 23 Jul. 2008), Ser. No. 12/234,012 (filed 19 Sept. 2008) and Ser. No. 12/234,018 (filed 19 Sep. 2008). Moreover, the present invention can be practiced using developments described in the following U.S. Patent Applications, each of which was filed on even date herewith and is hereby incorporated herein by reference: Ser. No. 12/342,565, entitled "PETROLEUM COKE COMPOSITIONS FOR CATALYTIC GASIFICATION"; Ser. No. 12/343,149, entitled "STEAM GENERATING SLURRY GASIFIER FOR THE CATALYTIC GASIFICATION OF A CARBONACEOUS FEEDSTOCK" Ser. No. 12/342,608, entitled "PETROLEUM COKE COMPOSITIONS FOR CATALYTIC GASIFICATION" Ser. No. 12/342,578, entitled "COAL COMPOSITIONS FOR CATALYTIC GASIFICATION"; Ser. No. 12/342,596, entitled "PROCESSES FOR MAKING SYNTHESIS GAS AND SYNGAS-DERIVED PRODUCTS"; Ser. No. 12/342,663, entitled "CARBONACEOUS FUELS AND PROCESSES FOR MAKING AND USING THEM"; and Ser. No. 12/342,628, entitled "PROCESSES FOR MAKING SYNGAS-DERIVED PRODUCTS".

All publications, patent applications, patents and other references mentioned herein, if not otherwise indicated, are explicitly incorporated by reference herein in their entirety for all purposes as if fully set forth.

Unless otherwise defined, all technical and scientific terms used herein have the same meaning as commonly understood by one of ordinary skill in the art to which this disclosure belongs. In case of conflict, the present specification, including definitions, will control.

Except where expressly noted, trademarks are shown in upper case.

Although methods and materials similar or equivalent to those described herein can be used in the practice or testing of the present disclosure, suitable methods and materials are described herein.

Unless stated otherwise, all percentages, parts, ratios, etc., are by weight.

When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the endpoints thereof, and all integers and fractions within the range. It is not intended that the scope of the present disclosure be limited to the specific values recited when defining a range.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The use of "a" or "an" to describe the various elements and components herein is merely for convenience and to give a general sense of the disclosure. This description should be read to include one or at least one and the singular also includes the plural unless it is obvious that it is meant otherwise.

The materials, methods, and examples herein are illustrative only and, except as specifically stated, are not intended to be limiting.

Carbonaceous Composition

The term "carbonaceous material" or "carbonaceous composition" as used herein includes a carbon source, typically coal, petroleum coke, asphaltenes and/or liquid petroleum residue, but may broadly include any source of carbon suitable for gasification, including biomass. The carbonaceous composition will generally include at least some ash, typically at least about 3 wt % ash (based on the weight of the carbonaceous composition).

The term "petroleum coke" as used herein includes both (i) the solid thermal decomposition product of high-boiling hydrocarbon fractions obtained in petroleum processing (heavy residues—"resid petcoke") and (ii) the solid thermal decomposition product of processing tar sands (bituminous sands or oil sands—"tar sands petcoke"). Such carbonization products include, for example, green, calcined, needle and fluidized bed petroleum coke.

Resid petcoke can be derived from a crude oil, for example, by coking processes used for upgrading heavy-gravity residual crude oil, which petroleum coke contains ash as a minor component, typically about 1.0 wt % or less, and more typically about 0.5 wt % of less, based on the weight of the coke. Typically, the ash in such lower-ash cokes predominantly comprises metals such as nickel and vanadium.

Tar sands petcoke can be derived from an oil sand, for example, by coking processes used for upgrading oil sand. Tar sands petcoke contains ash as a minor component, typically in the range of about 2 wt % to about 12 wt %, and more typically in the range of about 4 wt % to about 12 wt %, based on the overall weight of the tar sands petcoke. Typically, the ash in such higher-ash cokes predominantly comprises materials such as compounds of silicon and/or aluminum.

The petroleum coke can comprise at least about 70 wt % carbon, at least about 80 wt % carbon, or at least about 90 wt % carbon, based on the total weight of the petroleum coke. Typically, the petroleum coke comprises less than about 20 wt % percent inorganic compounds, based on the weight of the petroleum coke.

The term "asphaltene" as used herein is an aromatic carbonaceous solid at room temperature, and can be derived, from example, from the processing of crude oil and crude oil tar sands.

The term "liquid petroleum residue" as used herein includes both (i) the liquid thermal decomposition product of high-boiling hydrocarbon fractions obtained in petroleum processing (heavy residues—"resid liquid petroleum residue") and (ii) the liquid thermal decomposition product of processing tar sands (bituminous sands or oil sands—"tar sands liquid petroleum residue"). The liquid petroleum residue is substantially non-solid; for example, it can take the form of a thick fluid or a sludge.

Resid liquid petroleum residue can be derived from a crude oil, for example, by processes used for upgrading heavy-gravity crude oil distillation residue. Such liquid petroleum residue contains ash as a minor component, typically about 1.0 wt % or less, and more typically about 0.5 wt % of less, based on the weight of the residue. Typically, the ash in such lower-ash residues predominantly comprises metals such as nickel and vanadium.

Tar sands liquid petroleum residue can be derived from an oil sand, for example, by processes used for upgrading oil sand. Tar sands liquid petroleum residue contains ash as a minor component, typically in the range of about 2 wt % to about 12 wt %, and more typically in the range of about 4 wt % to about 12 wt %, based on the overall weight of the residue. Typically, the ash in such higher-ash residues predominantly comprises materials such as compounds of silicon and/or aluminum.

The term "coal" as used herein means peat, lignite, sub-bituminous coal, bituminous coal, anthracite, or mixtures thereof. In certain embodiments, the coal has a carbon content of less than about 85%, or less than about 80%, or less than about 75%, or less than about 70%, or less than about 65%, or less than about 60%, or less than about 55%, or less than about 50% by weight, based on the total coal weight. In other embodiments, the coal has a carbon content ranging up to about 85%, or up to about 80%, or up to about 75% by weight, based on total coal weight. Examples of useful coals include, but are not limited to, Illinois #6, Pittsburgh #8, Beulah (N.D.), Utah Blind Canyon, and Powder River Basin (PRB) coals. Anthracite, bituminous coal, sub-bituminous coal, and lignite coal may contain about 10 wt %, from about 5 to about 7 wt %, from about 4 to about 8 wt %, and from about 9 to about 11 wt %, ash by total weight of the coal on a dry basis, respectively. However, the ash content of any particular coal source will depend on the rank and source of the coal, as is familiar to those skilled in the art. See, for example, "Coal Data: A Reference", Energy Information Administration, Office of Coal, Nuclear, Electric and Alternate Fuels, U.S. Department of Energy, DOE/EIA-0064(93), February 1995.

The term "ash" as used herein includes inorganic compounds that occur within the carbon source. The ash typically includes compounds of silicon, aluminum, calcium, iron, vanadium, sulfur, and the like. Such compounds include inorganic oxides, such as silica, alumina, ferric oxide, etc., but may also include a variety of minerals containing one or more of silicon, aluminum, calcium, iron, and vanadium. The term "ash" may be used to refer to such compounds present in the carbon source prior to gasification, and may also be used to refer to such compounds present in the char after gasification.

Alkali Metal Compounds

As used herein, the terms "alkali metal compound" refers to a free alkali metal, as a neutral atom or ion, or to a molecular entity, such as a salt, that contains an alkali metal. Additionally, the term "alkali metal" may refer either to an individual alkali metal compound, as heretofore defined, or may also refer to a plurality of such alkali metal compounds. An alkali metal compound capable of being substantially solubilized by water is referred to as a "soluble alkali metal compound." Examples of a soluble alkali metal compound include free alkali metal cations and water-soluble alkali metal salts, such as potassium carbonate, potassium hydroxide, and the like. An alkali metal compound incapable of being substantially solubilized by water is referred to as an "insoluble alkali metal compound." Examples of an insoluble alkali metal compound include water-insoluble alkali metal salts and/or molecular entities, such as potassium aluminosilicate.

Alkali metal compounds suitable for use as a gasification catalyst include compounds selected from the group consisting of alkali metal carbonates, bicarbonates, formates, oxalates, amides, hydroxides, acetates, halides, nitrates, sulfides, and polysulfides. For example, the catalyst can comprise one or more of $Na_2CO_3$, $K_2CO_3$, $Rb_2CO_3$, $Li_2CO_3$, $Cs_2CO_3$, NaOH, KOH, RbOH, or CsOH, and particularly, potassium carbonate and/or potassium hydroxide.

Catalyst-Loaded Carbonaceous Feedstock

The carbonaceous composition is generally loaded with an amount of an alkali metal. Typically, the quantity of the alkali metal in the composition is sufficient to provide a ratio of alkali metal atoms to carbon atoms ranging from about 0.01, or from about 0.02, or from about 0.03, or from about 0.04, to about 0.06, or to about 0.07, or to about 0.08. Further, the alkali metal is typically loaded onto a carbon source to achieve an alkali metal content of from about 3 to about 10 times more than the combined ash content of the carbonaceous material (e.g., coal and/or petroleum coke), on a mass basis.

Any methods known to those skilled in the art can be used to associate one or more gasification catalysts with the carbonaceous composition. Such methods include, but are not limited to, admixing with a solid catalyst source and impregnating the catalyst onto the carbonaceous solid. Several impregnation methods known to those skilled in the art can be employed to incorporate the gasification catalysts. These methods include, but are not limited to, incipient wetness impregnation, evaporative impregnation, vacuum impregnation, dip impregnation, and combinations of these methods. Gasification catalysts can be impregnated into the carbonaceous solids by slurrying with a solution (e.g., aqueous) of the catalyst.

That portion of the carbonaceous feedstock of a particle size suitable for use in the gasifying reactor can then be further processed, for example, to impregnate one or more catalysts and/or cocatalysts by methods known in the art, for example, as disclosed in U.S. Pat. Nos. 4,069,304 and 5,435,940; previously incorporated U.S. Pat. Nos. 4,092,125, 4,468,231 and 4,551,155; previously incorporated U.S. patent application Ser. Nos. 12/234,012 and 12/234,018; and previously incorporated U.S. patent applications Ser. No. 12/342,565, entitled "PETROLEUM COKE COMPOSITIONS FOR CATALYTIC GASIFICATION", Ser. No. 12/342,608, entitled "PETROLEUM COKE COMPOSITIONS FOR CATALYTIC GASIFICATION", Ser. No. 12/343,159, entitled "CONTINUOUS PROCESS FOR CONVERTING CARBONACEOUS FEEDSTOCK INTO GASEOUS PRODUCTS", and Ser. No. 12/342,578, entitled "COAL COMPOSITIONS FOR CATALYTIC GASIFICATION".

One particular method suitable for combining a coal particulate with a gasification catalyst to provide a catalyzed carbonaceous feedstock where the catalyst has been associated with the coal particulate via ion exchange is described in previously incorporated U.S. patent application Ser. No. 12/178,380 (filed 23 Jul. 2008). The catalyst loading by ion exchange mechanism is maximized (based on adsorption isotherms specifically developed for the coal), and the additional catalyst retained on the wet cake, including inside the pores, is controlled so that the total catalyst target value is obtained in a controlled manner. Such loading provides a catalyzed coal particulate as a wet cake. The catalyst loaded and dewatered wet coal cake typically contains, for example, about 50% moisture. The total amount of catalyst loaded is controlled by controlling the concentration of catalyst components in the solution, as well as the contact time, temperature and method, as can be readily determined by those of ordinary skill in the relevant art based on the characteristics of the starting coal.

The catalyzed feedstock can be stored for future use or transferred to a feed operation for introduction into the gasification reactor. The catalyzed feedstock can be conveyed to storage or feed operations according to any methods known to those skilled in the art, for example, a screw conveyer or pneumatic transport.

Catalytic Gasification Methods

The extraction and recovery methods of the present invention are particularly useful in integrated gasification processes for converting carbonaceous feedstocks, such as petroleum coke, liquid petroleum residue, asphaltenes and/or coal to combustible gases, such as methane. The gasification reactors for such processes are typically operated at moderately high pressures and temperature, requiring introduction of a carbonaceous material (i.e. a feedstock) to the reaction zone of the gasification reactor while maintaining the required temperature, pressure, and flow rate of the feedstock. Those skilled in the art are familiar with feed systems for providing feedstocks to high pressure and/or temperature environments, including, star feeders, screw feeders, rotary pistons, and lock-hoppers. It should be understood that the feed system can include two or more pressure-balanced elements, such as lock hoppers, which would be used alternately.

Suitable gasification reactors include counter-current fixed bed, co-current fixed bed, fluidized bed, entrained flow, and moving bed reactors. The gasification reactor typically will be operated at moderate temperatures of at least about 450° C., or of at least about 600° C. or above, to about 900° C., or to about 750° C., or to about 700° C.; and at pressures of at least about 50 psig, or at least about 200 psig, or at least about 400 psig, to about 1000 psig, or to about 700 psig, or to about 600 psig.

The gas utilized in the gasification reactor for pressurization and reactions of the particulate composition typically comprises steam, and optionally, oxygen or air, and are supplied to the reactor according to methods known to those skilled in the art. For example, any of the steam boilers known to those skilled in the art can supply steam to the reactor. Such boilers can be powered, for example, through the use of any carbonaceous material such as powdered coal, biomass etc., and including but not limited to rejected carbonaceous materials from the particulate composition preparation operation (e.g., fines, supra). Steam can also be supplied from a second gasification reactor coupled to a combustion turbine where the exhaust from the reactor is thermally exchanged to a water source and produce steam.

Recycled steam from other process operations can also be used for supplying steam to the reactor. For example, when the slurried particulate composition is dried with a fluid bed slurry drier, as discussed previously, the steam generated through vaporization can be fed to the gasification reactor.

The small amount of required heat input for the catalytic coal gasification reaction can be provided by superheating a gas mixture of steam and recycle gas feeding the gasification reactor by any method known to one skilled in the art. In one method, compressed recycle gas of CO and $H_2$ can be mixed with steam and the resulting steam/recycle gas mixture can be further superheated by heat exchange with the gasification reactor effluent followed by superheating in a recycle gas furnace.

A methane reformer can be included in the process to supplement the recycle CO and $H_2$ fed to the reactor to ensure that the reaction is run under thermally neutral (adiabatic) conditions. In such instances, methane can be supplied for the reformer from the methane product, as described below.

Reaction of the particulate composition under the described conditions typically provides a crude product gas and a char. The char produced in the gasification reactor during the present processes typically is removed from the gasification reactor for sampling, purging, and/or catalyst recovery. Methods for removing char are well known to those skilled in the art. One such method taught by EP-A-0102828, for example, can be employed. The char can be periodically withdrawn from the gasification reactor through a lock hopper system, although other methods are known to those skilled in the art.

Crude product gas effluent leaving the gasification reactor can pass through a portion of the gasification reactor which serves as a disengagement zone where particles too heavy to be entrained by the gas leaving the gasification reactor (i.e., fines) are returned to the fluidized bed. The disengagement zone can include one or more internal cyclone separators or similar devices for removing fines and particulates from the gas. The gas effluent passing through the disengagement zone and leaving the gasification reactor generally contains $CH_4$, $CO_2$, $H_2$ and CO, $H_2S$, $NH_3$, unreacted steam, entrained fines, and other contaminants such as COS.

The gas stream from which the fines have been removed can then be passed through a heat exchanger to cool the gas and the recovered heat can be used to preheat recycle gas and generate high pressure steam. Residual entrained fines can also be removed by any suitable means such as external cyclone separators followed by Venturi scrubbers. The recovered fines can be processed to recover alkali metal catalyst.

The gas stream exiting the Venturi scrubbers can be fed to COS hydrolysis reactors for COS removal (sour process) and further cooled in a heat exchanger to recover residual heat prior to entering water scrubbers for ammonia recovery, yielding a scrubbed gas comprising at least $H_2S$, $CO_2$, CO, $H_2$, and $CH_4$. Methods for COS hydrolysis are known to those skilled in the art, for example, see U.S. Pat. No. 4,100,256.

The residual heat from the scrubbed gas can be used to generate low pressure steam. Scrubber water and sour process condensate can be processed to strip and recover $H_2S$, $CO_2$ and $NH_3$; such processes are well known to those skilled in the art. $NH_3$ can typically be recovered as an aqueous solution (e.g., 20 wt %).

A subsequent acid gas removal process can be used to remove $H_2S$ and $CO_2$ from the scrubbed gas stream by a physical absorption method involving solvent treatment of the gas to give a cleaned gas stream. Such processes involve contacting the scrubbed gas with a solvent such as monoethanolamine, diethanolamine, methyldiethanolamine, diisopropylamine, diglycolamine, a solution of sodium salts of amino acids, methanol, hot potassium carbonate or the like. One method can involve the use of Selexol® (UOP LLC, Des Plaines, Ill. USA) or Rectisol® (Lurgi AG, Frankfurt am Main, Germany) solvent having two trains; each train consisting of an $H_2S$ absorber and a $CO_2$ absorber. The spent solvent containing $H_2S$, $CO_2$ and other contaminants can be regenerated by any method known to those skilled in the art, including contacting the spent solvent with steam or other stripping gas to remove the contaminants or by passing the spent solvent through stripper columns. Recovered acid gases can be sent for sulfur recovery processing. The resulting cleaned gas stream contains mostly $CH_4$, $H_2$, and CO and, typically, small amounts of $CO_2$ and $H_2O$. Any recovered $H_2S$ from the acid gas removal and sour water stripping can be converted to elemental sulfur by any method known to those skilled in the art, including the Claus process. Sulfur can be recovered as a molten liquid.

The cleaned gas stream can be further processed to separate and recover $CH_4$ by any suitable gas separation method known to those skilled in the art including, but not limited to, cryogenic distillation and the use of molecular sieves or ceramic membranes. One method for recovering $CH_4$ from the cleaned gas stream involves the combined use of molecular sieve absorbers to remove residual $H_2O$ and $CO_2$ and cryogenic distillation to fractionate and recover $CH_4$. Typically, two gas streams can be produced by the gas separation process, a methane product stream and a syngas stream ($H_2$ and CO). The syngas stream can be compressed and recycled to the gasification reactor. If necessary, a portion of the methane product can be directed to a reformer, as discussed previously and/or a portion of the methane product can be used as plant fuel.

Char

The term "char" as used herein includes mineral ash, unconverted carbonaceous material, and water-soluble alkali metal compounds and water-insoluble alkali metal compounds within the other solids. The char produced in the gasification reactor typically is removed from the gasification reactor for sampling, purging, and/or catalyst recovery. Methods for removing char are well known to those skilled in the art. One such method, described in previously incorporated EP-A-0102828, for example, can be employed. The char can be periodically withdrawn from the gasification reactor through a lock hopper system, although other methods are known to those skilled in the art.

Catalyst Recovery

Alkali metal salts, particularly sodium and potassium salts, are useful as catalysts in catalytic coal gasification reactions. Alkali metal catalyst-loaded carbonaceous mixtures are generally prepared and then introduced into a gasification reactor, or can be formed in situ by introducing alkali metal catalyst and carbonaceous particles separately into the reactor.

After gasification, the alkali metal may exist in the char as species that are either soluble or insoluble. In particular, alkali metal can react with mineral ash at temperatures above about 500-600° C. to form insoluble alkali metal aluminosilicates, such as kaliophilite. As an aluminosilicate, or other insoluble compounds, the alkali metal is ineffective as a catalyst.

As discussed, supra, char is periodically removed from the gasification reactor through a solid purge. Because the char has a substantial quantity of soluble and insoluble alkali metal, it is desirable to recover the alkali metal from the char for reuse as a gasification catalyst. Catalyst loss in the solid purge must generally be compensated for by a reintroduction of additional catalyst, i.e., a catalyst make-up stream. Processes have been developed to recover alkali metal from the solid purge in order to reduce raw material costs and to minimize environmental impact of a catalytic gasification process. For example, a recovery and recycling process is described in previously incorporated US2007/0277437A1.

The present invention provides a novel process for extracting and recovering soluble and insoluble alkali metal from char.

1. Char Quenching (100)

Referring to FIG. 1, a char (10) removed from a gasification reactor can be quenched in an aqueous medium (15) by any suitable means known to those of skill in the art to fracture the char and form a quenched char slurry (20) comprising soluble alkali metal compounds and insoluble matter comprising insoluble alkali metal compounds. One particularly useful quenching method is described in previously incorporated US2007/0277437A1.

The invention places no particular limits on the ratio of aqueous medium to char, or on the temperature of the aqueous medium. In some embodiments, however, the wt/wt ratio of water in the aqueous medium to the water-insoluble component of the char ranges from about 3:1, or from about 5:1, up to about 7:1, or up to about 15:1. Additionally, in some embodiments, the aqueous medium has a temperature that ranges from about 95° C. up to about 110° C., or up to about 140° C., or up to about 200° C., or up to about 300° C. The pressure need not be elevated above atmospheric pressure. In some embodiments, however, the quenching occurs at pressures higher than atmospheric pressure. For example, the quenching may occur at pressures up to about 25 psig, or up to about 40 psig, or up to about 60 psig, or up to about 80 psig, or up to about 400 psig (including the partial pressure of $CO_2$). The quenching process preferably occurs under a stream of gas that is substantially free of oxygen or other oxidants and comprises carbon dioxide.

The quenching step fractures the heated char by dissolving the rather large amount of water soluble alkali metal compounds (e.g., carbonates) that holds it together such that a quenched char slurry results. The char leaves the gasification reactor at high temperature, and it is typically cooled down. For example, the temperature of the char may range from about 35° C., or from about 50° C., or from about 75° C., up to about 200° C., or up to about 300° C., or up to about 400° C. In some embodiments, the char has an elevated temperature ranging from about 50° C. to about 600° C. The quenched char slurry comprises both soluble alkali metal and insoluble alkali metal. As the char fractures, soluble alkali metal leaches into the aqueous solution.

The char quenching is preferably performed in the substantial absence of gaseous oxygen. For example, the leaching environment has less than about 1% gaseous oxygen, or less than about 0.5% gaseous oxygen, less than about 0.1% gaseous oxygen, less than about 0.01% gaseous oxygen, or less than about 0.005% gaseous oxygen, based on the total volume.

In some embodiments, the aqueous medium used in the quenching may comprise a wash stream that results from a washing step of the present invention, described, infra.

2. Contacting of Quenched Char Slurry with Carbon Dioxide (200)

The first contacting of the quenched char slurry (20) with carbon dioxide (25) occurs under pressure and temperature suitable to convert at least a portion of the insoluble alkali metal compounds to one or more soluble alkali metal compounds, and produce a first leached slurry (30) comprising the soluble alkali metal compounds and residual insoluble matter. In the alternative, this process step is referred to as a first leaching or a first hydrothermal leaching.

The hydrothermal leaching may be performed by any suitable means known to those of skill in the art for performing hydrothermal leaching. For example, in some embodiments, the first hydrothermal leaching step is carried out in three pressurized continuous flow stirred tank reactors (CSTRs) in series (in three co-current stages). In other embodiments, for example, the first hydrothermal leaching step is carried out in a single horizontal pressure leaching vessel with internal weirs and stirrers to provide between 3-6 internal stages for the slurry.

The contacting of the carbon dioxide (25) with the char slurry (20) may occur by any means known to those of skill in the art suitable for introducing a gas into a slurry. Suitable methods include, but are not limited to, solubilizing the gas under pressure with gas-phase entrainment stirring or bubbling the gas through the slurry.

The temperature and pressure are selected to be suitable for converting at least a portion of the insoluble alkali metal compounds to one or more soluble alkali metal compounds. The selection of a suitable temperature and pressure will depend, among other factors, on the composition of the carbonaceous feedstock: Higher temperatures and/or pressures may be more suitable for carbonaceous feedstock having higher mineral ash content (e.g., Powder River Basin coal with 7-10% ash).

Suitable temperature, pressure, and duration for hydrothermal leaching may, for example, include the following: a temperature of at least about 120° C.; at total pressure of at least about 150 psig; a partial pressure of steam of at least about 15 psig; a partial pressure of carbon dioxide ranging from about 50 psig to about 500 psig; and a duration of about 60 minutes to about 120 minutes.

In some embodiments, the hydrothermal leaching may occur at lower pressures and temperatures. For these embodiments, suitable temperatures and pressure (including partial pressures of various gases), and the duration of the leaching may be selected based on the knowledge of one skilled in the art. Suitable temperatures may, for example, range from about 90° C., or from about 100° C., or from about 110° C., up to about 120° C., or up to about 130° C., or up to about 140° C., or up to about 160° C. The leaching is typically carried out in the presence of steam. Suitable partial pressures of steam, for example, range from about 3 psig, or from about 6 psig, up to about 14 psig, up to about 20 psig. Suitable total pressures, for example, range from about 30 psig, or from about 40 psig, or from about 50 psig, up to about 75 psig, or up to about 90 psig, or up to about 110 psig. Suitable partial pressures of carbon dioxide may, for example, range from about 25 psig, or from about 40 psig, or from about 60 psig, to about 100 psig, to about 120 psig, to about 140 psig, or to about 170 psig. Suitable durations, for example, range from about 15 minutes, or from about 30 minutes, or from about 45 minutes, up to about 60 minutes, or up to about 90 minutes, or up to about 120 minutes.

In other embodiments, the hydrothermal leaching may occur at higher pressures and temperatures. For these embodiments, suitable temperatures and pressures (including partial pressures of various gases), and the duration may be selected based on the knowledge of one skilled in the art. Suitable temperatures may, for example, range from about 150° C., or from about 170° C., or from about 180° C., or from about 190° C., up to about 210° C., or up to about 220° C., or up to about 230° C., or up to about 250° C. In some embodiments, a suitable temperature is about 200° C. Suitable partial pressures of carbon dioxide range from about 200 psig, or from about 300 psig, or from about 350 psig, up to about 450 psig, or up to about 500 psig, or up to about 600 psig. In some embodiments, a suitable partial pressure of carbon dioxide is about 400 psig. The hydrothermal leaching is typically carried out in the presence of steam. Suitable partial pressures of steam range from about 130 psig, or from about 170 psig, or from about 190 psig, up to about 230 psig, up to about 250 psig, up to about 290 psig. In some embodiments, a suitable partial pressure of steam is about 212 psig. Suitable total pressures for carrying out the hydrothermal leaching ranges from about 350 psig, or from about 450 psig, or from about 550 psig, up to about 670 psig, or up to about 750 psig, or up to about 850 psig. In some embodiments, a suitable total pressure is about 620 psig. Suitable partial pressures of carbon dioxide are, for example, at least about 100 psig, at least about 200 psig, at least about 250 psig, or at least about 300 psig, or at least about 350 psig. Suitable durations for carrying out the hydrothermal leaching range from about 30 minutes, or from about 60 minutes, or from about 90 minutes, up to about 150 minutes, or up to about 180 minutes, or up to about 240 minutes. In some embodiments, the hydrothermal leaching is suitably carried out for about 120 minutes.

The hydrothermal leaching is carried out in the substantial absence of gaseous oxygen or other oxidants. For example, the leaching environment has less than about 1% gaseous oxygen, or less than about 0.5% gaseous oxygen, less than about 0.1% gaseous oxygen, less than about 0.01% gaseous oxygen, or less than about 0.005% gaseous oxygen, based on the total volume.

The leaching process converts at least a portion of the insoluble alkali metal compounds to one or more soluble alkali metal compounds. As used in the leaching process, the conversion of insoluble alkali metal compounds to soluble alkali metal compounds generally involves the chemical conversion of a water-insoluble alkali metal compound (such as potassium aluminosilicate) into a water-soluble alkali metal compound (such as potassium carbonate).

The amount of insoluble alkali metal compounds converted to soluble alkali metal compounds in the leaching step will depend on a variety of factors, including the composition of the char, the temperature, the pressure (including the partial pressures of steam and carbon dioxide), and the duration of the leaching operation. The amount of insoluble alkali metal compound converted will also depend on the composition of the insoluble alkali metal compounds present in the char. Some insoluble alkali metal compounds, such as kaliophilite, are more difficult to convert into soluble alkali metal compounds than others. For example, the leaching step may convert at least about 5%, or at least about 10%, or at least about 20%, or at least about 40%, or at least about 50%, or at least about 60%, at least about 70%, or at least about 80% of the insoluble alkali metal compounds from the insoluble matter, based on the total moles of insoluble alkali metal compounds in the quenched char.

In some embodiments of the invention, the first leaching step is combined with the char quenching step into a single step. In these embodiments, the char quenching is performed at a pressure and temperature more typical for the first hydrothermal leaching step. Suitable temperatures may, for example, range from about 90° C., or from about 100° C., or from about 110° C., up to about 120° C., or up to about 130° C., or up to about 140° C., or up to about 160° C. Suitable total pressures, for example, range from about 30 psig, or from about 40 psig, or from about 50 psig, up to about 75 psig, or up to about 90 psig, or up to about 110 psig. At these elevated temperatures and pressures, the partial pressures of carbon dioxide and steam are similar to those for the first leaching step. By performing the char quenching under the temperature and pressure conditions typical of the first leaching step, the two steps are effectively combined. In these embodiments, the combined quenching/leaching step substantially leaches the water-soluble alkali metal compounds from the insoluble matter and converts at least a portion of the insoluble alkali metal compounds in the char to one or more soluble alkali metal compounds, and thereby produces a first leached slurry comprising soluble alkali metal compounds and residual insoluble matter.

3. Degassing (300)

The leached slurry (30) is degassed under suitable pressures and temperatures so as to remove a substantial portion of the excess carbon dioxide and hydrogen sulfide, if present, and produce a degassed leached slurry (40).

Any suitable degassing methods known to those of skill in the art may be used to perform the degassing step. In some embodiments, the second hydrothermal leaching step is carried out at a higher temperature and pressure than in the first hydrothermal leaching step. In these embodiments, different degassing methods may be selected according to the knowledge of one skilled in the art.

When degassing follows a lower pressure hydrothermal leaching step, the degassing may be performed by pumping and heating the leached slurry and flashing it into a flash drum. For these embodiments, a suitable temperature may be, for example, about 130° C. or higher, or about 140° C. or higher, about 145° C. or higher, or about 150° C. or higher. For these embodiments, after flashing into the flash drum, the slurry temperature may drop to 120° C. or less, or 110° C. or less, or 100° C. or less, or 95° C. or less. For these embodiments, suitable pressures range from about 10 to about 20 psig, or at about atmospheric pressure.

When degassing follows a hydrothermal leaching step performed at a higher temperature and pressure, the degassing may be performed by feeding a heated pressurized solution into a series of staged pressure let-down vessels equipped with stirring or other recirculation mechanisms. In some embodiments, the slurry may be cooled prior to being fed into a first pressure let-down vessel, for example to a suitable temperature of about 170° C. or below, or to about 150° C. or below, or to about 130° C. or below. Suitable pressures will depend on the pressure under which the second hydrothermal leaching was performed. Suitable pressures for degassing are, for example, about 300 psig or less, or about 100 psig or less, or about 50 psig or less, or about 25 psig or less.

The off-stream gas (35) may be handled by any means known to those of skill in the art. For example, the off gases from a let-down vessel may be fed, as needed, through gas/water breakdown drums and the separated water recycled into the degassed slurry. In some embodiments, the degassing apparatus is equipped with safety features for handling hydrogen sulfide as an off gas.

The degassing step results in the substantial removal of excess carbon dioxide. For example, the partial pressure of carbon dioxide is reduced to less than about 10 psig, or less than about 5 psig, or less than about 2 psig. The degassing also results in the substantial removal of excess hydrogen sulfide, if present. For example, the partial pressure of hydrogen sulfide is reduces to less than about 1 psig, or less than about 0.1 psig, less than about 0.05 psig, or less than about 0.01 psig.

In some embodiments, the degassing is carried out in the presence of a stream of carbon dioxide gas.

4. Separation and Recovery of Liquid from Partially Extracted Insoluble Matter (400)

A degassed leached slurry (40) is separated into a liquid stream (45) and a residual insoluble matter stream (50). The liquid stream (45) comprises recovered soluble alkali metal, including soluble alkali metal compounds that were converted from insoluble alkali metal compounds in the char. The residual insoluble matter stream (50) may also comprise a residual amount of soluble alkali metal compounds in addition to residual insoluble alkali metal compounds.

The residual insoluble matter steam (50) comprises at least a portion of the alkali metal contained in the insoluble matter of the char. For example, the residual insoluble matter steam comprises less than about 95 molar percent, or less than about 90 molar percent, or less than about 80 molar percent, or less than about 60 molar percent, or less than about 50 molar percent, or less than about 40 molar percent, or less than about 30 molar percent, of the alkali metal contained in the insoluble matter of the char.

The separation and recovery of the liquid stream from the solid stream may be carried out by typical methods of separating a liquid from a solid particulate. Illustrative methods include, but are not limited to, filtration (gravity or vacuum), centrifugation, use of a fluid press, decantation, and use of hydrocyclones.

The recovered liquid stream (45) will contain soluble alkali metal compounds that may be captured for reuse as a gasification catalyst. Methods for recovery of soluble alkali metal from an aqueous solvent for reuse as a gasification catalyst are known in the art. See, for example, previously incorporated US2007/0277437A1.

The recovered liquid stream (45) comprises a predominant portion of the alkali metal compounds from the degassed leached slurry (40). For example, the recovered liquid stream comprises at least about 50 molar percent, or at least about 55 molar percent, or at least about 60 molar percent, or at least about 65 molar percent, or at least about 70 molar percent, of the soluble alkali metal compounds from the degassed leached slurry.

5. Washing (500)

The residual insoluble matter stream (50) is washed with an aqueous medium to produce a wash stream (55) comprising at least a portion of the residual soluble alkali metal compounds in the residual insoluble matter stream (50), and a washed residual insoluble matter stream (60).

As used herein, the term "washing" is not limited to a single flush of the insoluble matter with an aqueous medium, such as water. Rather, each washing step may include multiple staged counter-washings of the insoluble matter. In some embodiments of the invention, the washing of the residual insoluble matter stream comprises at least three staged counter-washings. In some embodiments, the washing of the residual insoluble matter stream comprises at least six staged counter-washings. The washing may be performed according to any suitable method known to those of skill in the art. For example, the washing step may be performed using a continuous multi-stage counter-current system whereby solids and liquids travel in opposite directions. As known to those of skill in the art, the multi-stage counter current wash system may include mixers/settlers (CCD or decantation), mixers/filters, mixers/hydrocyclones, mixers/centrifuges, belt filters, and the like.

The wash stream (55) is recovered by typical means of separating a solid particulate from a liquid. Illustrative methods include, but are not limited to, filtration (gravity or vacuum), centrifugation, and use of a fluid press.

In some embodiments, the recovered wash stream (55) may be used as at least part of the aqueous medium (15) used for quenching the char.

A final residual matter stream (60) is also produced.

EXAMPLES

Example 1

Extraction of Soluble Potassium from High-$KAlSiO_4$ Ash Sample

An agglomerate char material was provided having a composition especially concentrated in kaliophilite. By weight, the sample was approximately 90% ash (including soluble and insoluble potassium) and about 10% carbon. The material was ground to a particle size (Dp80) of 68.5 microns. The sample was subjected to water at 95° C. in a nitrogen atmosphere. The sample was filtered, thoroughly washed to remove substantially all of the water-soluble alkali metal compounds, and dried. Analysis of the resulting sample indicated that the amount of water-soluble potassium removed from the sample amounted to 40.08 wt % (dry basis) of the original sample.

Example 2

Extraction of Insoluble Potassium from High-$KAlSiO_4$ Ash Sample

The post-treatment sample from Example 1 was used. The hot-water-washed sample consisted of 78.20 wt % of ash and 8.99 wt % fixed carbon. Analysis of the ash portion determined that the ash contained 36.42 wt % of silica, 15.72 wt % of alumina, 18.48 wt % of insoluble potassium oxide, 12.56 wt % of calcium oxide, 9.13 wt % of ferric oxide, and trace quantities of other inorganic oxides. SEM data confirmed that most of the insoluble potassium oxide in the ash is tied up in $KAlSiO_4$, primarily as kaliophilite and kalsilite.

To simulate the carbon dioxide hydrothermal leaching, the washed agglomerate sample was treated with water under elevated carbon dioxide pressures. The sample was held at 200° C. and treated for 3 hours. This acidic hydrothermal leaching simulation resulted in 51% extraction of the insoluble potassium from the ash sample. As a comparison, the same ash sample was treated according to the prior art lime digestion process. Lime digestion showed 86-89% recovery of insoluble potassium. Nevertheless, lime digestion may create other difficulties, such as continuous consumption of CaO, which offset any gains achieved by a higher extraction rate.

Example 3

Extraction of Insoluble Potassium from Typical Char Sample

A char sample was provided from the gasification (87-89% carbon conversion) of Class B catalyzed Powder River Basin coal. The dry sample was determined to contain 34.4 wt % potassium. The char sample was crushed and added to water to form a slurry in a nitrogen atmosphere. The slurry sample was added to an autoclave with additional water and an amount of potassium carbonate to simulate a recycle wash solution. The solution was purged with nitrogen and heated for 30 minutes at 150° C. The autoclave was cooled to ambient temperature. The solid was filtered and washed three times with water. Thus, the soluble potassium was largely removed from the sample. The washed wet solid was placed back into the autoclave and was heated in the presence of carbon dioxide and water, and was heated to 200° C. for 3 hours. After cooling, the filtration and washing streams were analyzed. The total potassium extraction was 98.8%. Thus, for a typical char sample from coal gasification, a simulation of an embodiment of the invention yields nearly complete extraction of insoluble potassium.

We claim:

1. A process for extracting and recovering alkali metal from a char, the char comprising (i) one or more soluble alkali metal compounds and (ii) insoluble matter comprising one or more insoluble alkali metal compounds, the process comprising the steps of:

(a) providing char at an elevated temperature ranging from 50° C. to about 600° C.;

(b) quenching the char in an aqueous medium to fracture the char and form a quenched char slurry;

(c) contacting the quenched char slurry with carbon dioxide under suitable pressure and temperature so as to convert at least a portion of the insoluble alkali metal compounds to one or more soluble alkali metal compounds, and produce a leached slurry comprising the soluble alkali metal compounds and residual insoluble matter;

(d) degassing the leached slurry under suitable pressure and temperature so as to remove a substantial portion of the excess carbon dioxide and hydrogen sulfide, if present, and produce a degassed leached slurry;

(e) separating the degassed leached slurry into a liquid stream and a residual insoluble matter stream, the liquid stream comprising a predominant portion of the soluble alkali metal compounds from the degassed leached slurry, and the residual insoluble matter stream comprising residual soluble alkali metal compounds and residual insoluble alkali metal compounds;

(f) recovering the liquid stream; and (g) washing the extracted insoluble matter stream with an aqueous medium to produce a wash stream comprising substantially all of the residual soluble alkali metal compounds from the residual insoluble matter stream, wherein the quenching and contacting is performed in the substantial absence of gaseous oxygen.

2. The process according to claim 1, wherein the residual insoluble matter stream comprises less than about 50 molar percent of the alkali metal contained in the insoluble matter of the char.

3. The process according to claim 1, wherein the residual insoluble matter stream comprises less than about 25 molar percent of the alkali metal from the char (based on the alkali metal content of the char).

4. The process according to claim 1, wherein in step (c), at least about 40 molar percent of the insoluble alkali metal compounds in the quenched char slurry are converted to soluble alkali metal compounds.

5. The process according to claim 1, wherein the char is a solid residue derived from gasification of a carbonaceous material in the presence of an alkali metal.

6. The process according to claim 5, wherein the carbonaceous material comprises one or more of coal, petroleum coke, asphaltene, liquid petroleum residue or biomass.

7. The process according to claim 1, wherein in step (b), the aqueous medium comprises the wash stream.

8. The process according to claim 1, wherein the alkali metal comprises sodium and/or potassium.

9. The process according to claim 1, wherein step (b) and step (c) are combined into a single step.

10. The process according to claim 9, wherein in the combination of step (b) and step (c) the temperature ranges from about 90° C. to about 160° C., and the total pressure ranges from about 30 psig up to about 110 psig.

11. The process according to claim 1, wherein in step (c) the temperature is at least about 120° C., the total pressure is at least about 150 psig, and a partial pressure of carbon dioxide ranges from about 50 psig to about 500 psig.

12. The process according to claim 1, wherein in step (c) the temperature ranges from about 90° C. up to about 160° C., the total pressure ranges from about 30 psig up to about 110 psig, and a partial pressure of carbon dioxide ranges from about 25 psig up to about 100 psig.

13. The process according to claim 1, wherein in step (c) the temperature ranges from about 150° C. up to about 250° C., the total pressure ranges from about 350 psig up to about 850 psig, and a partial pressure of carbon dioxide ranges from at least about 100 psig up to about 600 psig.

14. A process for catalytically converting a carbonaceous composition, in the presence of an alkali metal gasification catalyst, into a plurality of gaseous products, the process comprising the steps of:

(A) supplying a carbonaceous composition to a gasification reactor, the carbonaceous composition comprising an ash;

(B) reacting the carbonaceous composition in the gasification reactor in the presence of steam and an alkali metal gasification catalyst under suitable temperature and pressure to form (i) a char comprising alkali metal from the alkali metal gasification catalyst in the form of one or more soluble alkali metal compounds and one or more insoluble alkali metal compounds, and (ii) a plurality of gaseous products comprising methane and one or more of hydrogen, carbon monoxide, carbon dioxide, hydrogen sulfide, ammonia, and other higher hydrocarbons;

(C) removing a portion of the char from the gasification reactor;

(D) extracting and recovering a substantial portion of the alkali metal from the char; and (E) at least partially separating the plurality of gaseous products to produce a stream comprising a predominant amount of one of the gaseous products, wherein step (D) comprises the steps of:

(a) providing the char at an elevated temperature ranging from 50° C. to about 600° C.:

(b) quenching the char in an aqueous medium to fracture the char and form a quenched char slurry;

(c) contacting the quenched char slurry with carbon dioxide under suitable pressure and temperature so as to convert at least a portion of the insoluble alkali metal compounds to one or more soluble alkali metal compounds, and produce a leached slurry comprising the soluble alkali metal compounds and residual insoluble matter;

(d) degassing the leached slurry under suitable pressure and temperature so as to remove a substantial portion of the excess carbon dioxide and hydrogen sulfide, if present, and produce a degassed leached slurry;

(e) separating the degassed leached slurry into a liquid stream and a residual insoluble matter stream, the liquid stream comprising a predominant portion of the soluble alkali metal compounds from the degassed leached slurry, and the residual insoluble matter stream comprising residual soluble alkali metal compounds and residual insoluble alkali metal compounds;

(f) recovering the liquid stream; and (g) washing the extracted insoluble matter stream with an aqueous medium to produce a wash stream comprising substantially all of the residual soluble alkali metal compounds from the residual insoluble matter stream, wherein the quenching and contacting is performed in the substantial absence of gaseous oxygen.

15. The process according to claim 14, wherein the carbonaceous composition comprises one or more of coal, petroleum coke, asphaltene, liquid petroleum residue or biomass.

16. The process according to claim 14, wherein the stream comprises a predominant amount of methane.

17. The process according to claim 14, wherein the alkali metal comprises sodium and/or potassium.

18. The process according to claim 14, wherein in step (c) the temperature is at least about 120° C., the total pressure is at least about 150 psig, and a partial pressure of carbon dioxide ranges from about 50 psig to about 500 psig.

19. The process according to claim 14, wherein in step (c) the temperature ranges from about 90° C. up to about 160° C., the total pressure ranges from about 30 psig up to about 110 psig, and a partial pressure of carbon dioxide ranges from about 25 psig up to about 100 psig.

20. The process according to claim 14, wherein in step (c) the temperature ranges from about 150° C. up to about 250° C., the total pressure ranges from about 350 psig up to about 850 psig, and a partial pressure of carbon dioxide ranges from at least about 100 psig up to about 600 psig.

21. The process according to claim 14, wherein in the combination of step (b) and step (c) the temperature ranges from about 90° C. to about 160° C., and the total pressure ranges from about 30 psig up to about 110 psig.

* * * * *